US005747766A

United States Patent [19]

Waino et al.

[11] Patent Number: 5,747,766

[45] Date of Patent: May 5, 1998

[54] OPERATING MECHANISM USABLE WITH A VACUUM INTERRUPTER

[75] Inventors: Ronald Arvid Waino, South Milwaukee; Daniel James Schreiber, New Berlin, both of Wis.

[73] Assignee: Cooper Industries, Inc., Houston, Tex.

[21] Appl. No.: 391,592

[22] Filed: Feb. 21, 1995

Related U.S. Application Data

[63] Continuation-in-part of Ser. No. 33,087, Mar. 16, 1993, abandoned.

[51] Int. Cl.[6] ..... H01H 33/66

[52] U.S. Cl. ..... 218/140; 218/154

[58] Field of Search ..... 218/1, 2, 4–7, 218/8, 10, 14, 118–120, 121, 122, 134, 139, 140, 152–154

[56] References Cited

U.S. PATENT DOCUMENTS

| | | | |
|---|---|---|---|
| 2,804,521 | 8/1957 | VanRyan et al. | 200/98 |
| 3,526,735 | 9/1970 | Date | 200/153 |
| 3,784,774 | 1/1974 | Wilson | 200/144 B |
| 3,787,649 | 1/1974 | Goodwin, Jr. et al. | 200/153 L |
| 3,955,167 | 5/1976 | Kumbera | 200/144 B |
| 4,124,790 | 11/1978 | Kumbera et al. | 200/144 B |
| 4,225,763 | 9/1980 | Barkan | 200/144 B |
| 5,012,051 | 4/1991 | Tsukushi et al. | 200/148 B |
| 5,175,403 | 12/1992 | Hamm et al. | 200/144 B |
| 5,585,611 | 12/1996 | Harvey et al. | 218/155 |

*Primary Examiner*—Michael L. Gellner
*Assistant Examiner*—Michael A. Friedhofer
*Attorney, Agent, or Firm*—Burns, Doane, Swecker & Mathis LLP

[57] ABSTRACT

An operating mechanism for a vacuum interrupter which includes a spring driven multi-linked system moving the interrupter contacts open or closed with precise, controlled movement to minimize opening rebound, closing rebound and contact opening overtravel. Such a multi-linked system provides high contact separation forces and movement to a specific contact gap while simultaneously loading a closing spring to it's fully charged and latched state. This mechanism provides and maintains full contact pressure from the instant of contact make to the instant of contact separation.

13 Claims, 21 Drawing Sheets

FIG. 11A
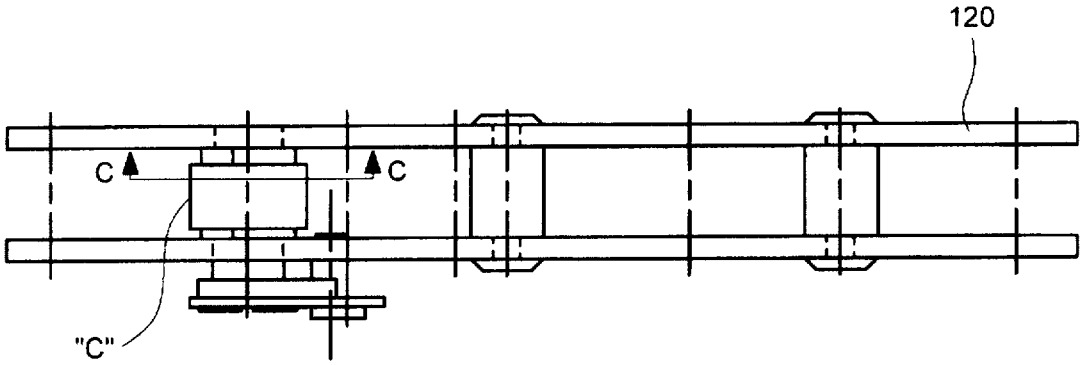
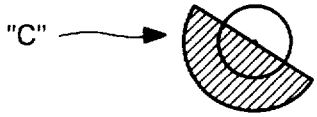
FIG. 11B
FIG. 11
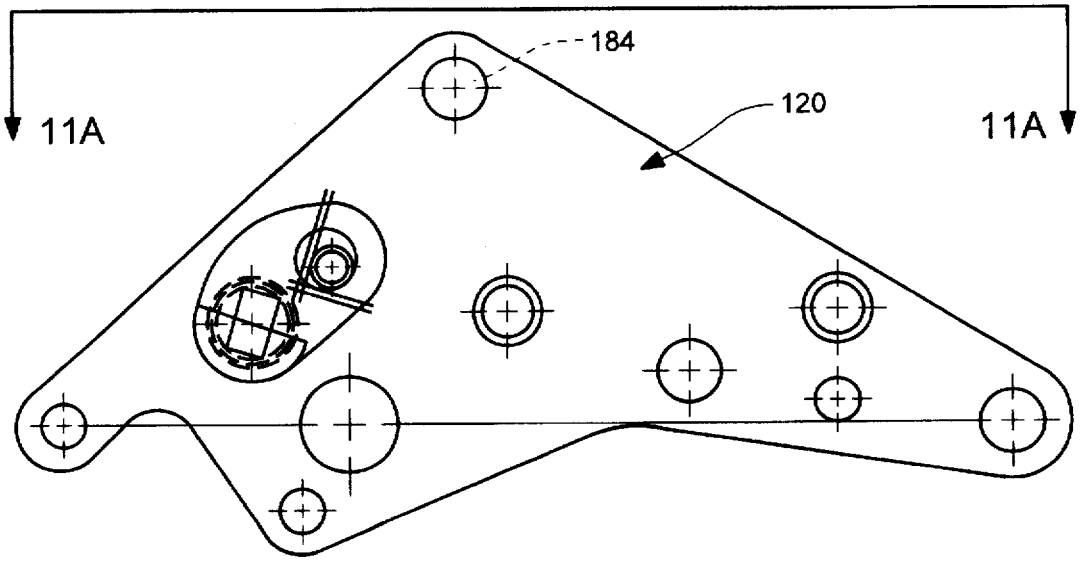

OPERATING MECHANISM USABLE WITH A VACUUM INTERRUPTER

This application is a continuation-in-part of application Ser. No. 08/033/087, filed Mar. 16, 1993 now abandoned.

This invention relates to an operating mechanism usable in a circuit interrupter of the type utilized in high power distribution systems and particularly those interrupters that may be automatically operated to permit energization or deenergization in response to abnormal line conditions, i.e. excessively high line current, on an automatic local basis, or upon command from a remote control center.

The utilization of vacuum interrupters to provide fast, low, arc energy interruption with long contact life requires essential, precise mechanical operating characteristics. Contact velocities, minimum rebound on the closing and opening operations, high contact pressure in a closed state and high separation forces required on opening are all desirable.

Often a solenoid was directly coupled through a preloaded spring member to drive vacuum interrupter contact(s) to a spring loaded closed position while simultaneously extending the opening spring(s) to a fully charged state. For such a device see U.S. Pat. No. 5,175,403, issued Dec. 29, 1992 to Sidney R. Hamm and Ronald A. Wainio (the latter being one of the joint inventors of the present invention) and assigned to the common assignee of this invention. In some instances, solenoids of this type were designed for a specific voltage rating, thus, making them susceptible to system voltage fluctuations directly affecting the contact close operation. The directly driven contact member driven through a trip free linkage to close may be released to open a partially charged opening spring due to contact make occurring prior to the fully closed position being reached. Also, inherent in the direct contact drive system to close condition is a prolonged delay in reaching the full required contact pressure.

Another prior art example may be found in the U.S. Pat. No. 3,787,649 issued to Edwin C. Goodwin, Jr., et al, on Jan. 22, 1974 as well as further prior art mechanisms that can be found in U.S. Pat. No. 3,526,735 issued to K. H. Date on Sep. 1, 1970 and in U.S. Pat. No. 2,804,521 issued to Anthony VanRyan et al on Aug. 27, 1957. In the opening sequence of the vacuum interrupter contacts in the above described prior art mechanisms, full contact pressure is not maintained to contact separation adding to the susceptibility of contact welding. Contact separation forces are the resultant of the static opening spring forces and any impact energy. For example, the opening and closing forces are inter-related, as can be seen in the U.S. Pat. No. 3,787,649 to Goodwin, et al. They utilize a preloaded pair of co-axially disposed springs 66 and 67 that extend between the base of U-shaped stirrup 53 and the head 61 of threaded bolt member 62. The springs 66,67 are loaded by adjusting locknuts 69–71 to a preload of 88 pounds. The movable contacts 42 engage their associated stationary contacts 39 when the cam follower rollers are at the midpoint of their inclined cam track portions. When the cam follower rollers 57, 57*a* and 57*b* continue up the cam ramp (after making initial closure of the contacts) the contact pressure only varies plus or minus four pounds. This would not be adequate to break any contact welds and furthermore these springs would not be exerting full pressure at the first instance of contact. This closing and opening problem exists in all of the cited prior art and which the present inventors are intimately acquainted with since they have worked on and with devices covered by the cited art owned by the common assignor of the present invention.

The higher the opening energy the more difficult it is to control contact rebound on opening. Some methods used to control rebound on opening were dashpots, shock absorbing materials and mechanical catches. In such prior art, the static and kinetic opening energy was variable, additionally, they utilized mechanical devices to catch and hold the contacts from rebounding to a closed condition after opening; dash pots and shock absorbing materials were used to dissipate the kinetic opening energy of the contact rod assembly. Mechanisms utilizing a variable closing energy source contend with variable contact closing speed and energy.

SUMMARY

The present invention strives to solve the aforementioned situations by providing an operating mechanism designed to overcome each of the problems created in the interrupter environment, by an operating mechanism that is designed to solve problems such as: (a) providing a consistent, high force requirement at contact separation; (b) eliminating contact rebound after opening; (c) eliminating excessive contact overtravel on opening; (d) eliminating opening spring energy being released from a partially charged state; (e) providing a closing energy consistent and independent of any variable charging means; (f) providing a minimal time delay in reaching full contact pressure after contact make; and (g) eliminating contact rebound after contact make on closing. All of these mechanism attributes would provide optimum characteristics for an operating mechanism of the type contemplated by the present invention for use in a vacuum interrupter and would permit superior performance of the switchgear controlled by it. For example, the prior art made contact and then increased or loaded the contact spring. In the present invention's device, the spring is constantly in a preloaded state before contact is made, and the spring serves a dual function in that the spring provides closing energy to move the contact as well as provide contact pressure when contacts are closed.

Thus, the present invention provides a stored spring energy operating mechanism to open and close linear moving members such as interrupter contacts on single or multiphase circuit interrupters. The mechanism includes a spring driven multi-linked system moving the interrupter contacts open or closed with precise, controlled movement to minimize opening rebound, closing rebound and contact opening overtravel. Such a multi-linked system provides high contact separation forces and movement to a specific contact gap while simultaneously loading a closing spring to it's fully charged and latched state. This mechanism provides and maintains full contact pressure from the instant of contact make to the instant of contact separation.

A primary key to providing consistent opening and closing operations is the use of independent stored spring energy for both the make and the break functions and the sequential scheme to charge the opening spring prior to releasing a precharged closing spring and subsequent contact closing. These and other advantages will become apparent when the specification is read in conjunction with the attached drawings, wherein similar parts are designated by similar numerals.

BRIEF DESCRIPTION OF THE DRAWINGS

FIG. 11 is a vertical front view of the toggle latch plate assembly;

FIG. 11A is a top plan view taken along line 11A—11A in FIG. 11;

FIG. 11B is a fragmentary partial section of the cam-latch adapted for engagement with latch assembly shown in FIG. 12;

DETAILED SPECIFICATION

Figure 1:
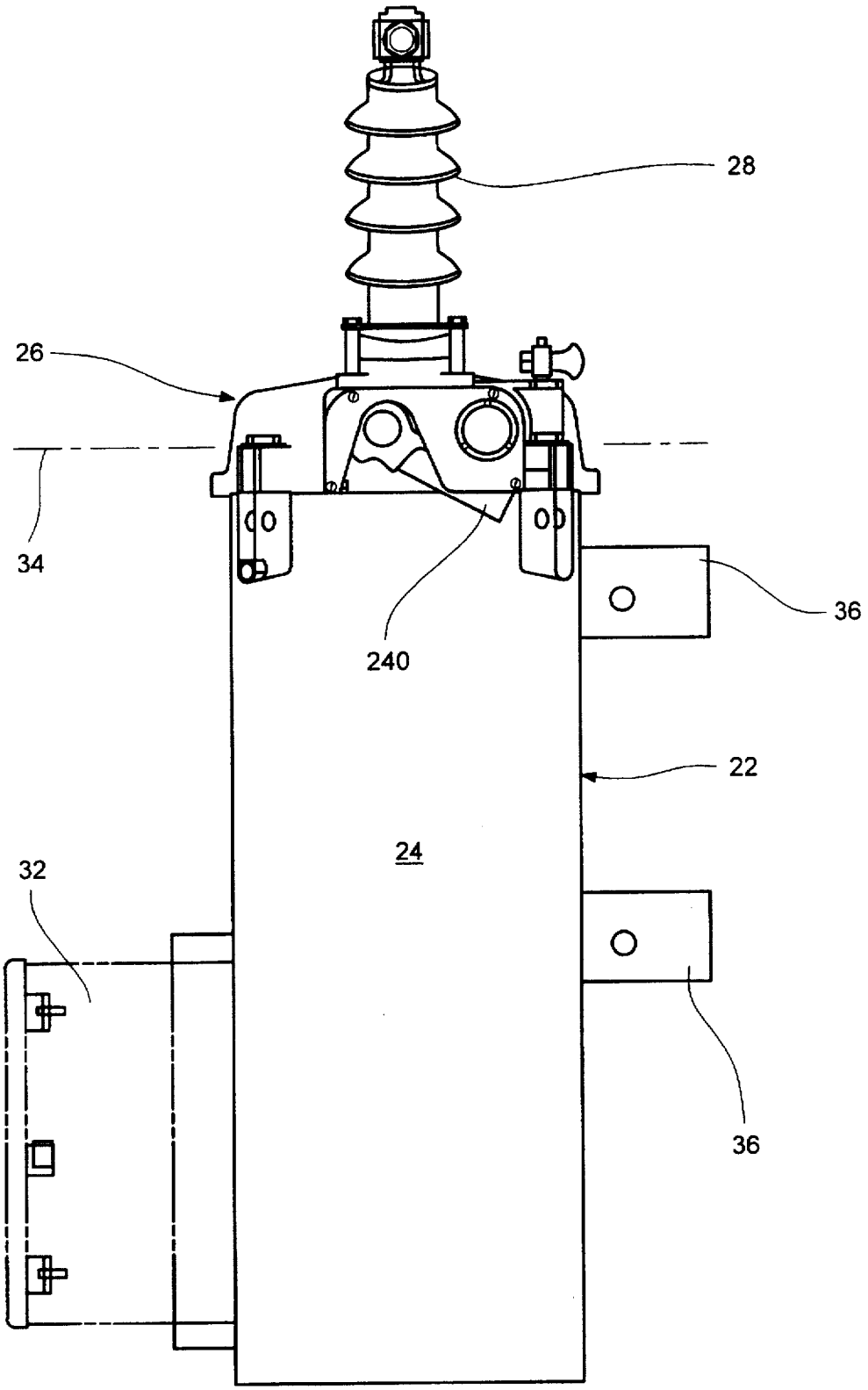
FIG. 1 is a vertical elevational view of the exterior of a single phase vacuum recloser utilizing an operating mechanism of the type contemplated by the present invention.

Referring to the drawings, and particularly FIGS. 3 through 18, there is illustrated a linear operating mechanism, generally designated 20, adapted for use with a single phase high voltage circuit interrupter device 22 positioned within an electrical power distribution system. The major components of such an interrupter device 22 include a tank 24; a head assembly 26, enclosing the operating mechanism 20 (the primary contribution of the present invention); the head 26 also carrying the insulated bushings 28,30. The tank 24 also externally carries an electronic controller 32 and mounting flanges 36, while the interior volume of the tank is filled with transformer type oil, to a level substantially indicated by the dashed line 34, as is well known in the art. Being a supplier to public utilities, the assignee and the inventors abide by the rules relating to "SCADA" defined as: remotely controlled "Supervisory Control and Data Acquisition". By following the teachings and requirements of SCADA a utility can by remote radio signal interrogate and/or change device status.

Thus, major elements of the interrupter 22 controlled by the operating mechanism 20 of the present invention include: a source of motive power, i.e., a pot coil assembly 38 accepting a plunger 40 and connecting rod 42; an opening and closing solenoid contactor 44; a vacuum interrupter 46 having associated support members 48; a rod 50 and connector 52 assembly provide spring-loaded linear movement through a sealed bellows (not shown) for the contacts in the vacuum interrupter 46; and a current transformer (not shown) for sensing the line current.

The closing solenoid contactor 44 is coupled to operating mechanism 20 through screws 54 and an elongated insulated link 56, with the contactor 44 being mechanically driven to momentarily energize pot coil 38 to provide an upward charging motion through plunger 40 and rod 42. The rod 42 is flattened at its upper end, as at 43, and apertured to accept pin 58 (see FIG. 17 for detail). The rod 42 is moved to the position shown in FIG. 3 resulting in a disconnection of contactor 44 and immediate de-energization of coil 38.

Operating mechanism 20 coupled through pin 60 to the flattened end 51 of a second rod 50 and connector 52 drives the vacuum interrupter 46 contacts, not shown, to the open or closed positions, as is known in the art. A current transformer, as well known in the art, senses current levels passing through the interrupter/recloser sending a proportional signal to an electronic control 32, shown generally in FIGS. 1, 2, which initiates trip and close signals, which shall be discussed further hereinafter.

To carry out the proposed solutions set forth herein-above to the seven problems enumerated above that face the utility companies, please refer to FIGS. 4–19 which disclose the operating mechanism 20 which is the subject matter of the present invention. The discussion of the vacuum interrupter 46, the pot coil 38, the solenoid contactor 44 set forth above is for the purpose of providing an environment in which the present invention can be utilized. While a single phase high voltage interrupter/recloser is described, it must be recognized that the operating mechanism can be also readily made available for use with multi-phase circuits. Additionally, it also can be utilized in other environments where positive linear actuation within designated parameters is required.

The operating mechanism 20 is generally supported on a round apertured plate 70 with a pair of centrally disposed spaced vertically disposed brackets or wall-like members 72, 74 each having an outwardly directed apertured flange 73, 75, respectively, on which the wall-like members are mounted on plate 70 and retained thereon by carriage bolts 76.

It will be appreciated that while the description below discusses various links, pins and levers in the singular, in actuality, in most instances, there generally are a pair of elements acting in parallel on opposite sides of the centerline between the pair of brackets or wall-like members 72, 74. This balances the load on the mechanism as well as providing multiple points of access to particular forms of motion, i.e., linear, rotary and arcuate.

Figure 5:
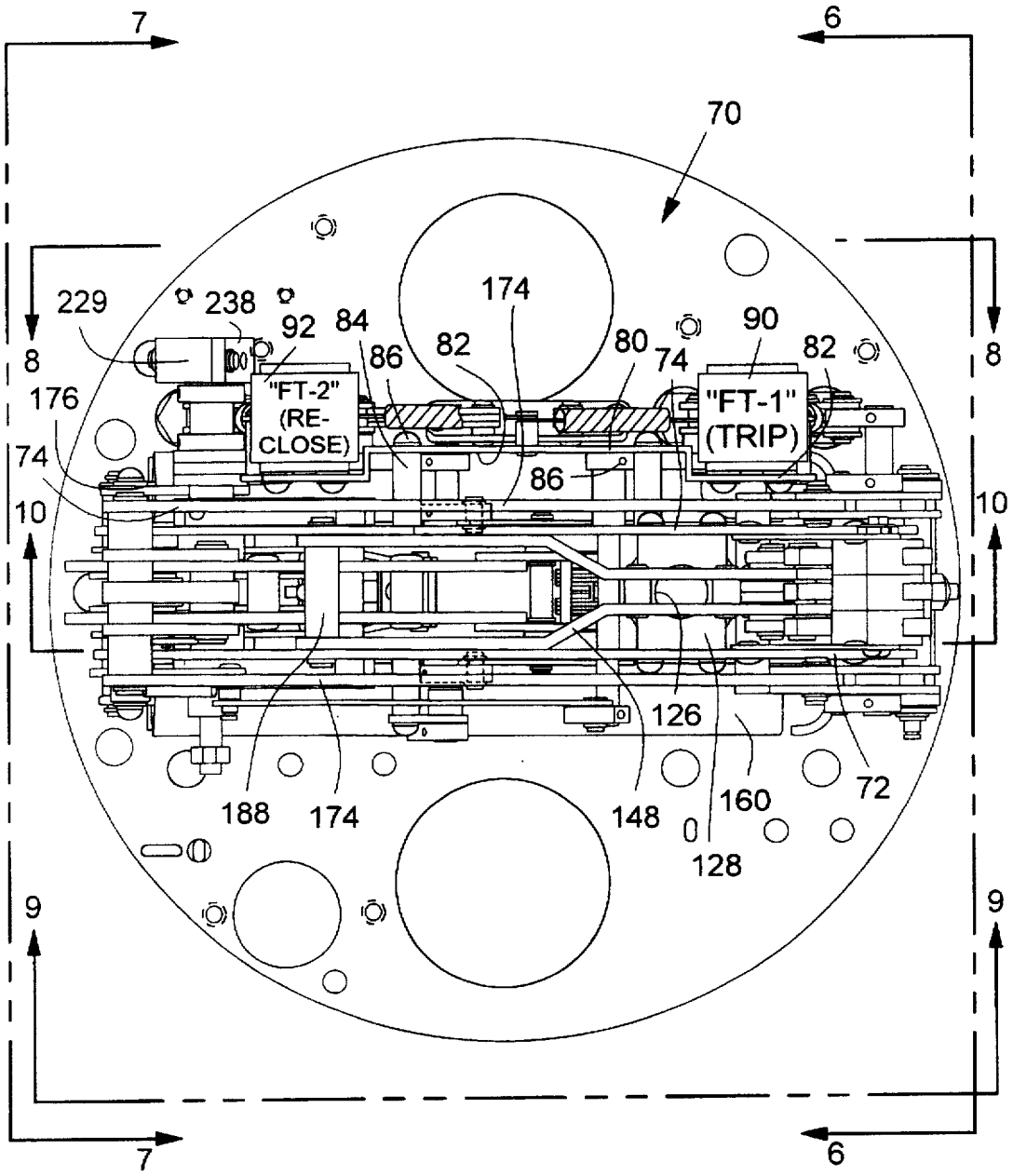
FIG. 5 is a plan view of the operating mechanism removed from the tank of FIG. 1.
Figure 6:
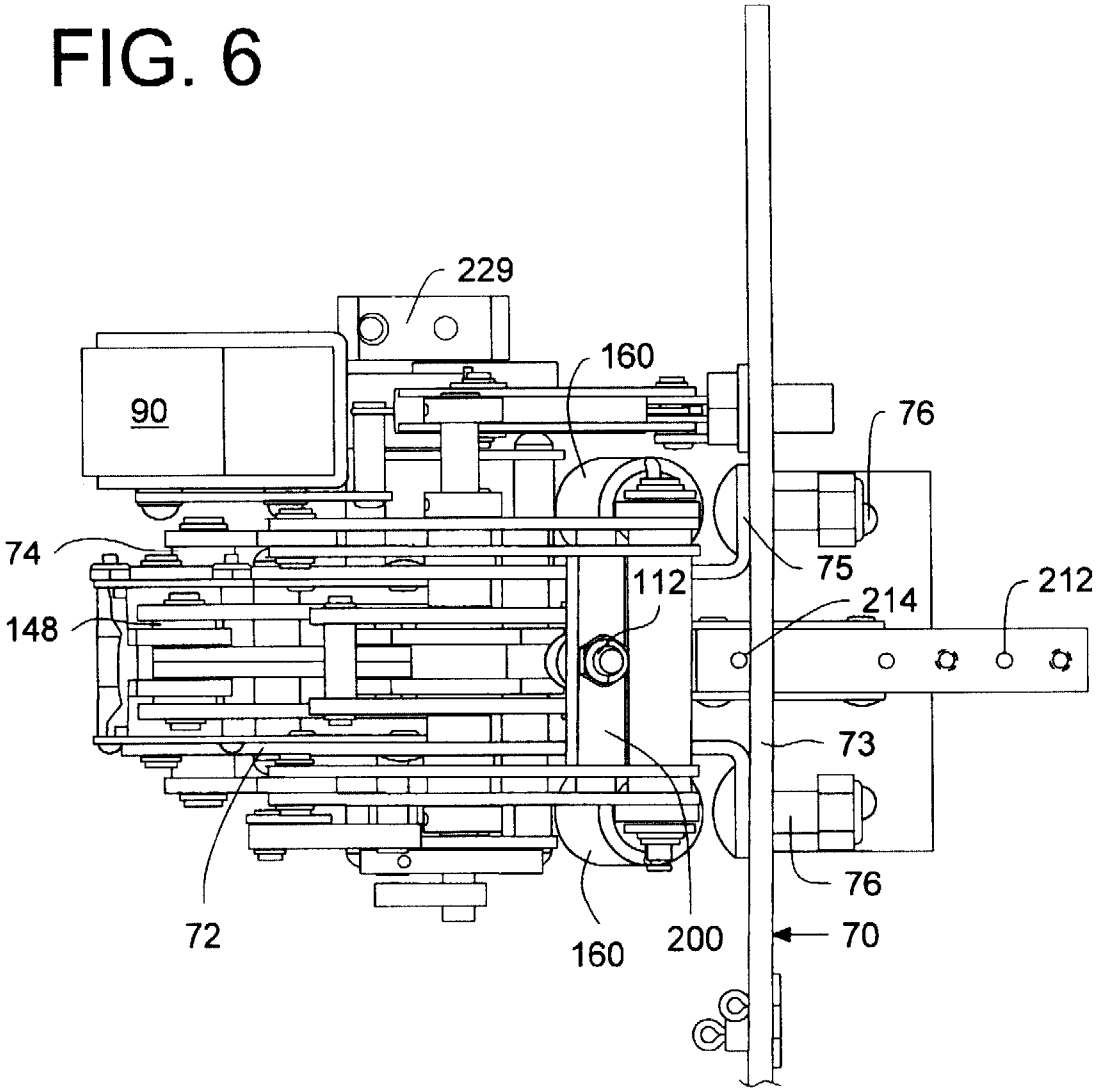
FIG. 6 is an end elevational view taken along line 6—6 of FIG. 5.
Figure 7:
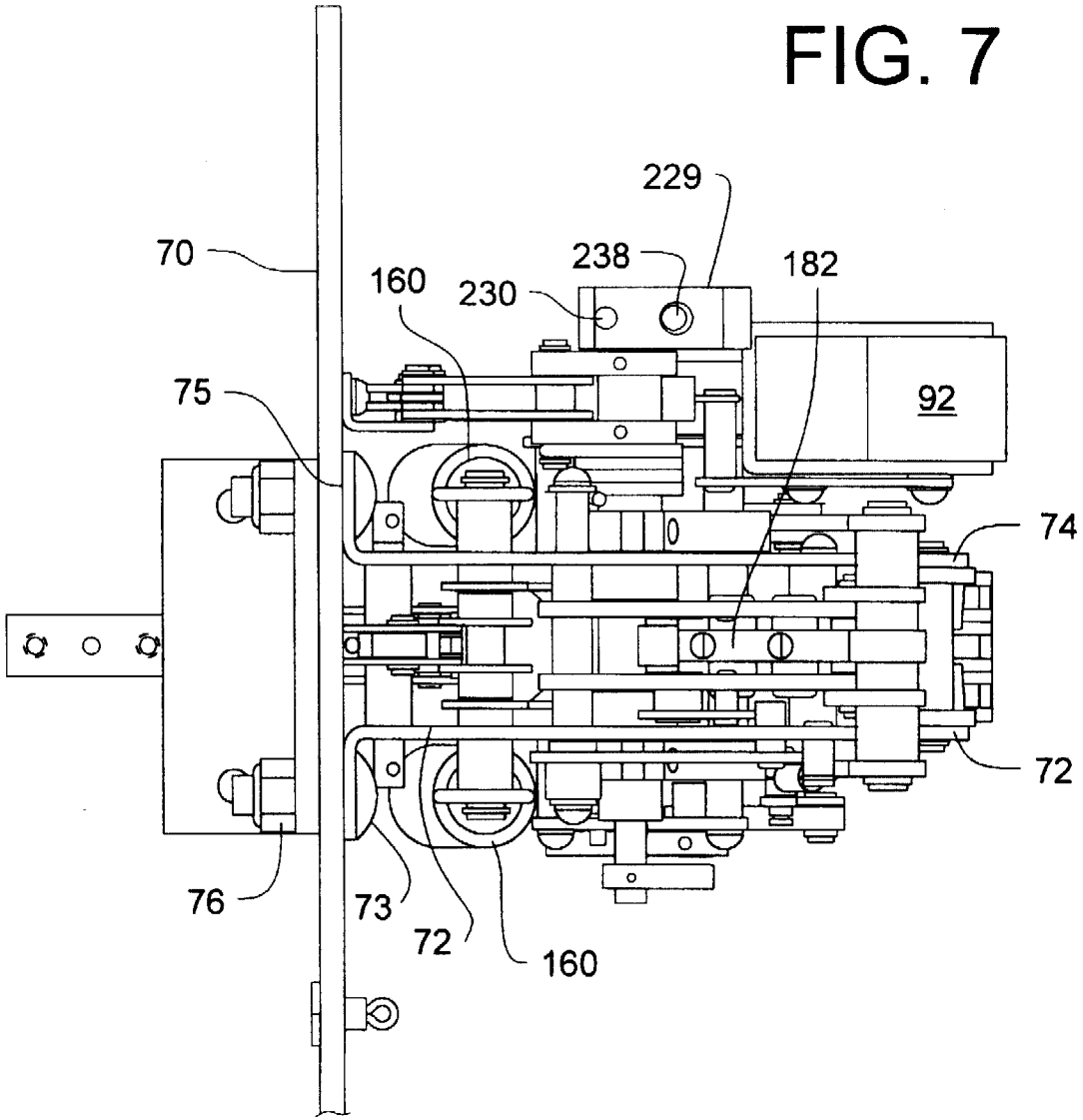
FIG. 7 is the opposite end elevational view taken along line 7—7 of FIG. 5.
Figure 8:
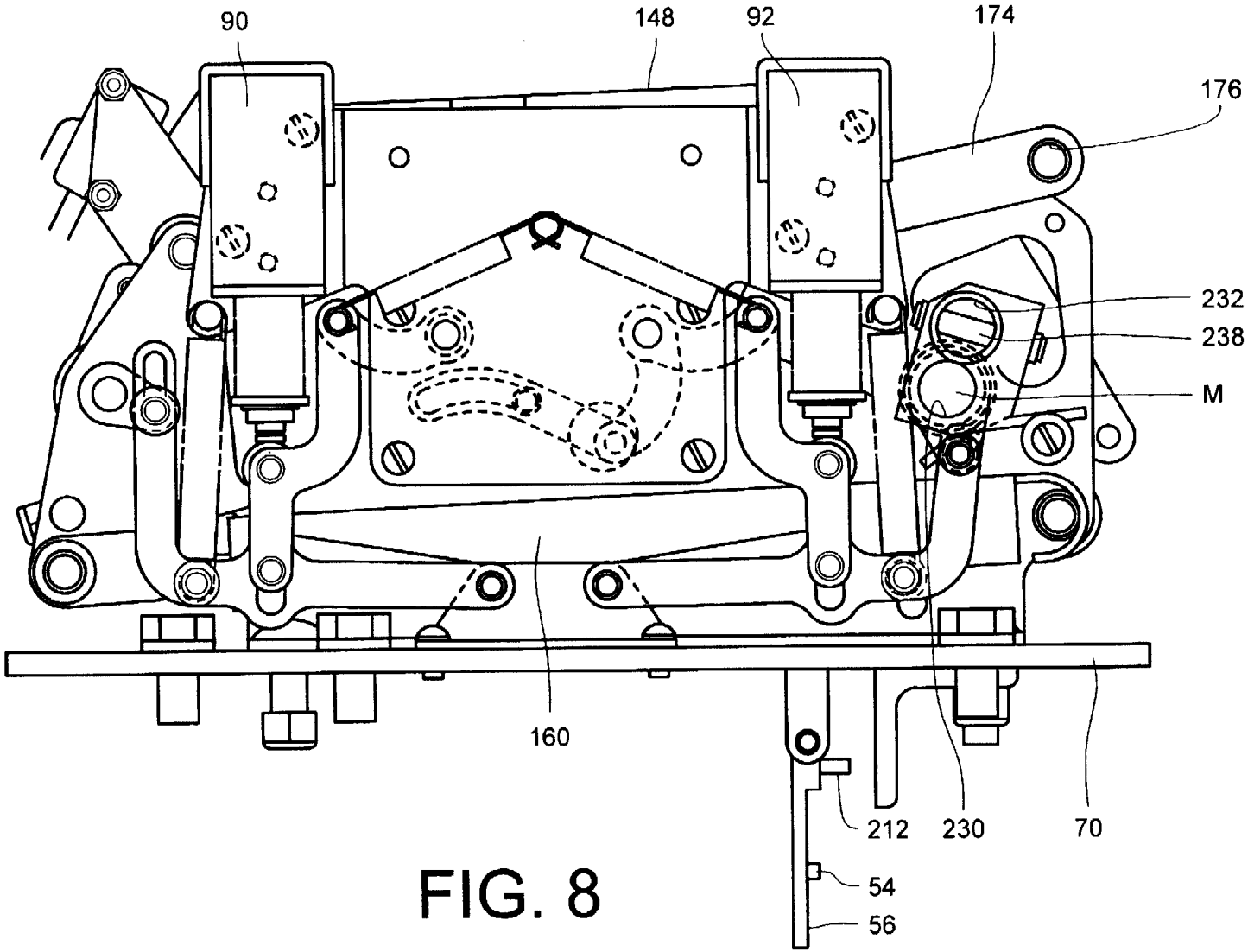
FIG. 8 is a partial backside elevational view of the operating mechanism as viewed along line 8—8 of FIG. 5.
Figure 9:
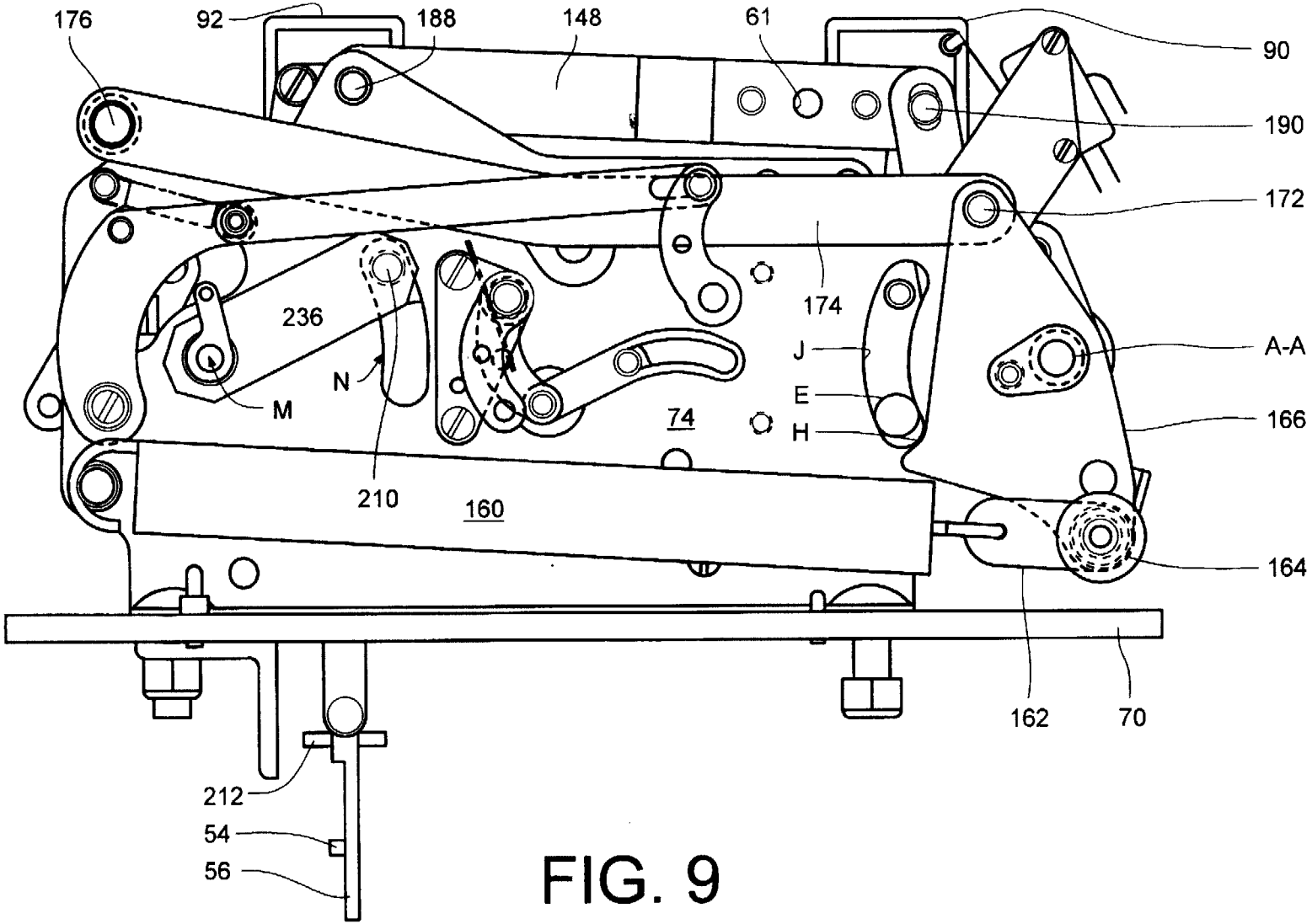
FIG. 9 is a frontal elevational view of the mechanism taken along line 9—9 of FIG. 5.
Figure 10:
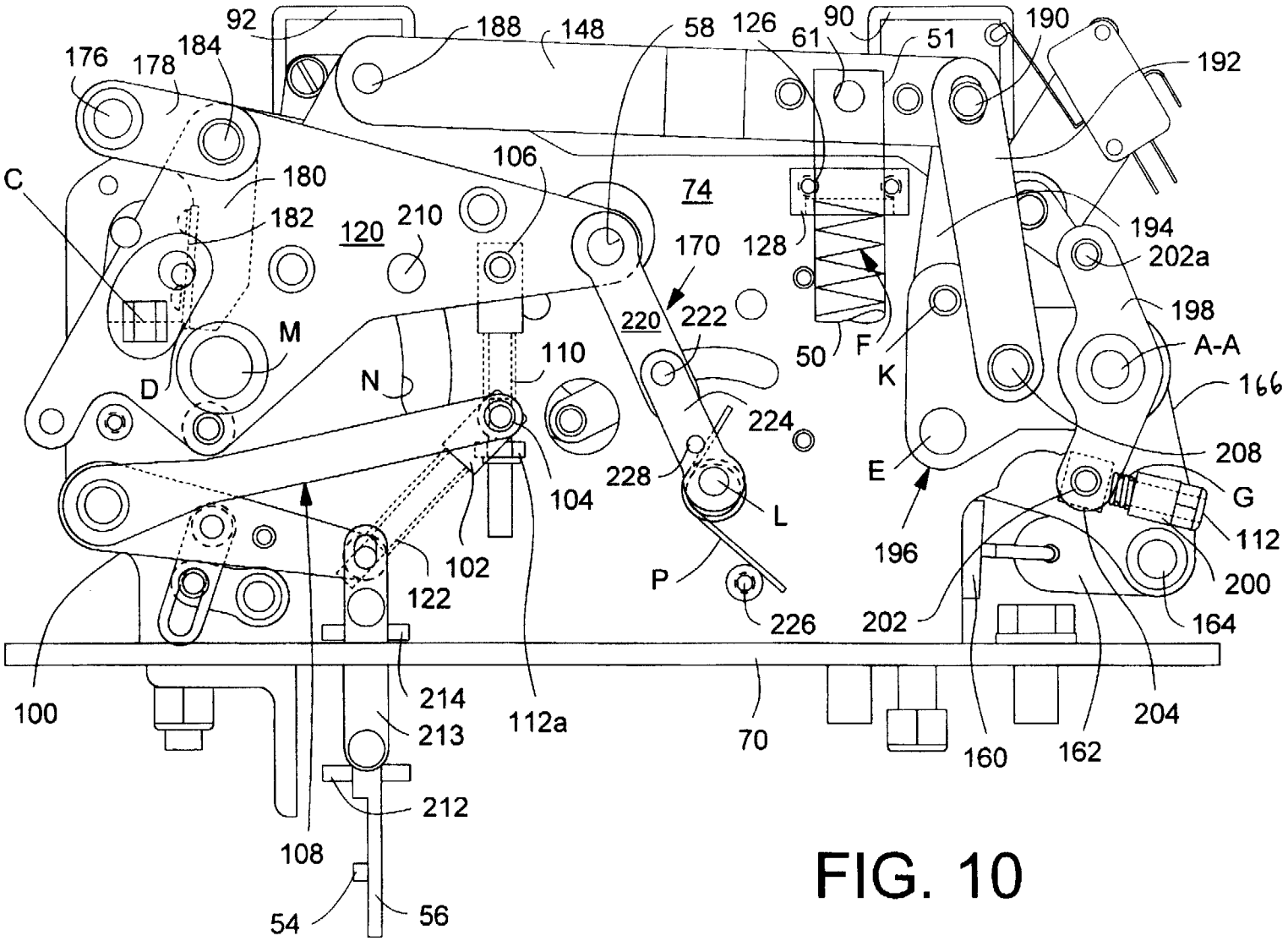
FIG. 10 is an elevational view in partial section taken along line 10—10 of FIG. 5.

One of the various assemblies associated with this mechanism is the flux tripper assembly 80, best seen in FIG. 5, which includes a stepped plate 82 mounted on spacers 84 to wall 74 by screws 86; with plate 82 supporting electromagnetic release devices FT-1 TRIP designated 90 and FT-2 RE-CLOSE designated 92. Devices 90, 92 are used to sequence the mechanism 20 via the electronic control logic 32. All of the associated linkage, namely, 100, 102, 104, 106, 108, 110, 58, 122 and 112A are the actuating mechanism linkage for the closing of solenoid contactor 44 by means of link 56. It is an over toggle-type mechanism coupled through pin 58 to the toggle latch plate assembly 120 which drives spring 122, bracket and pin assembly 102 through an over-center position of lever assembly 100, and particularly the limiting bar 213 that carries the limit pins 212 and 214 that limit the movement of the link 56 in up and down directions to open or close the closing solenoid contactor 44 connected to link 56. The contactor 44 would be in the open position with the linkage as shown in FIG. 10.

Figure 3:
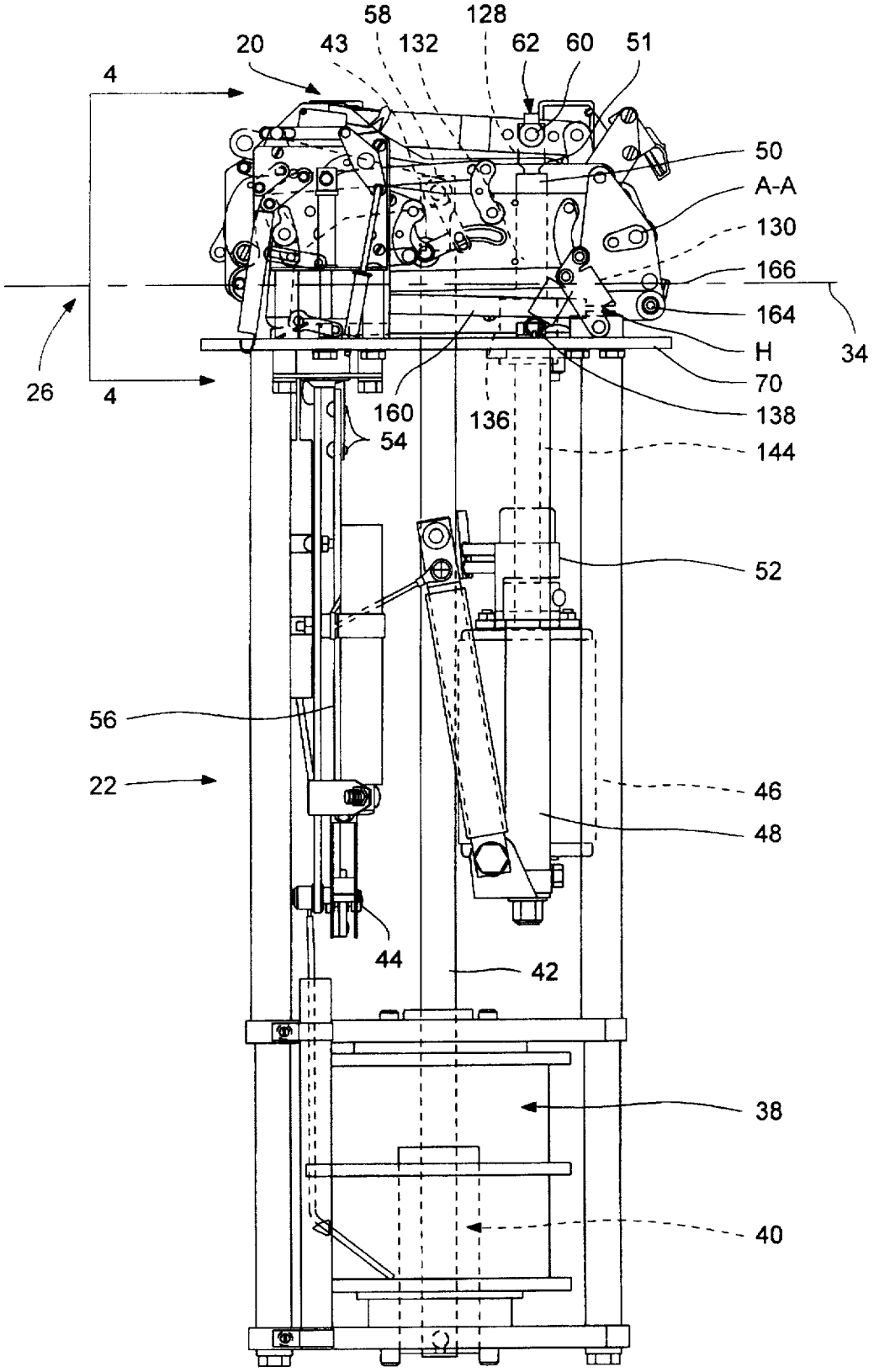
FIG. 3 is a vertical elevational view of substantially all of the operating mechanism, vacuum interrupter, and motive power means normally positioned within a tank of the type shown in FIG. 1.
Figure 4:
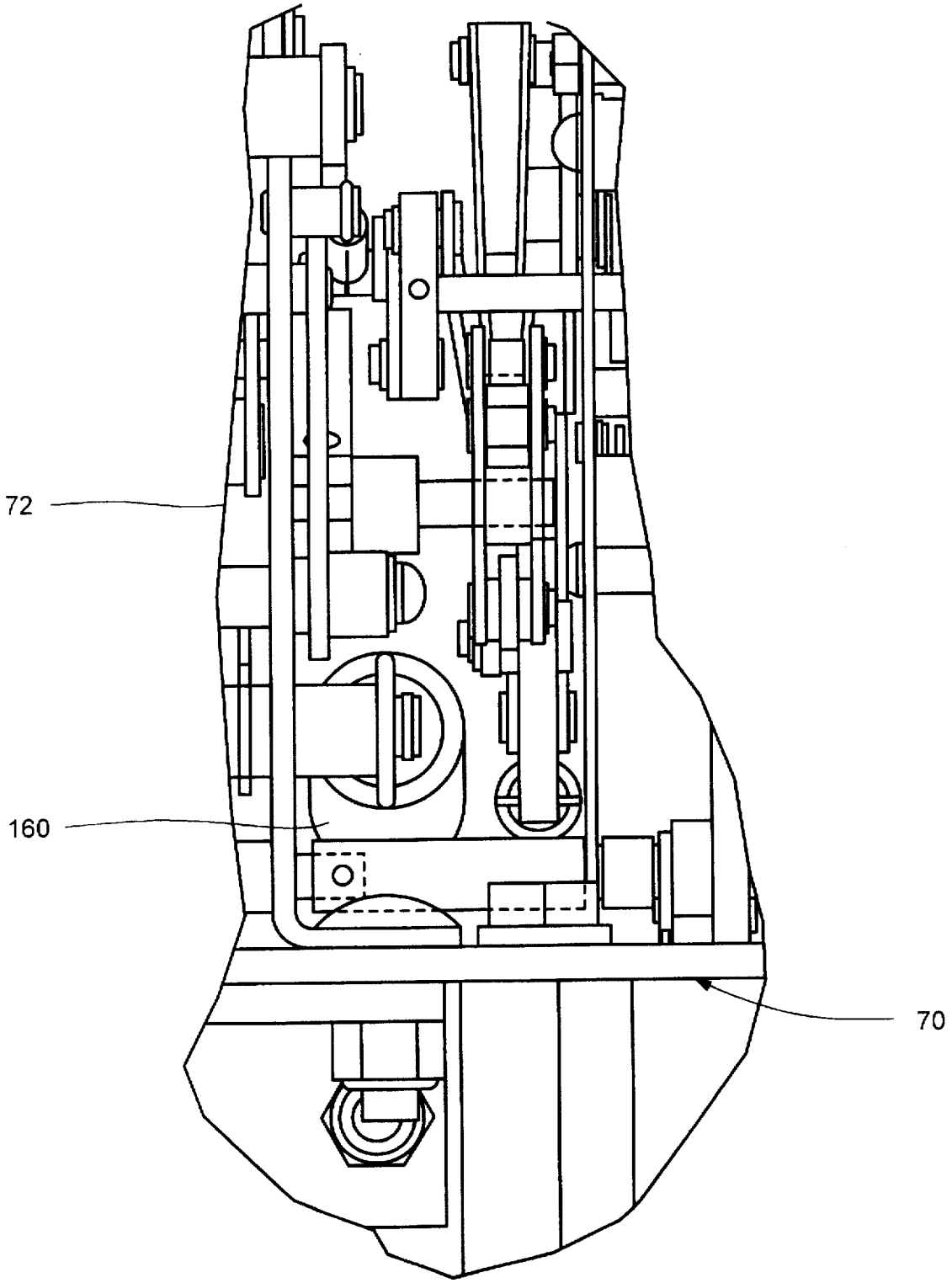
FIG. 4 is a fragmentary end view of the operating mechanism taken along line 4—4 in FIG. 3.
Figure 13:
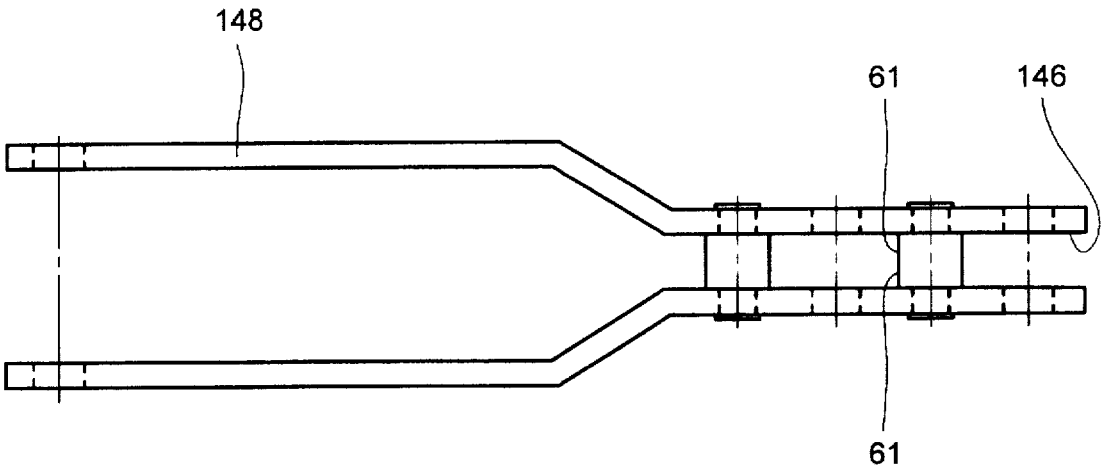
FIGS. 13, 13A is a top plan view and a front elevational view of a pair of riveted links forming a yoke-like assembly.
Figure 13A:
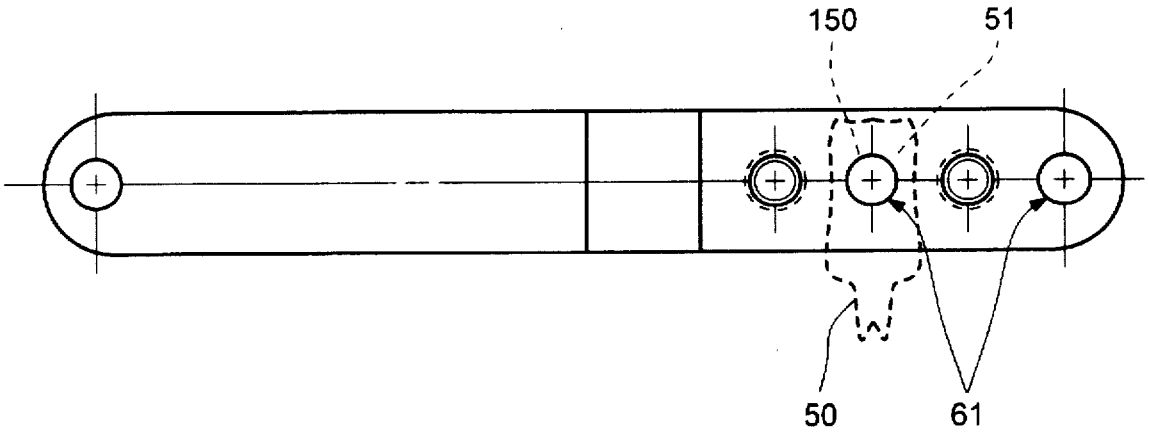
Figure 14:
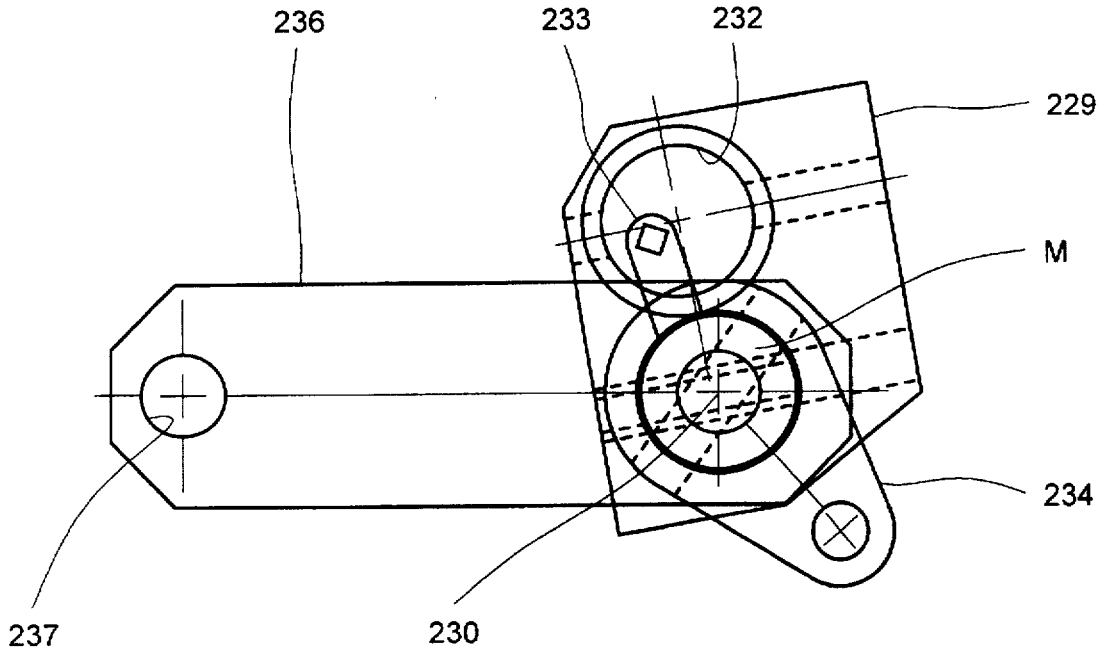
FIGS. 14, 14A is an end view and a front elevational view of the closing shaft assembly.
Figure 14A:
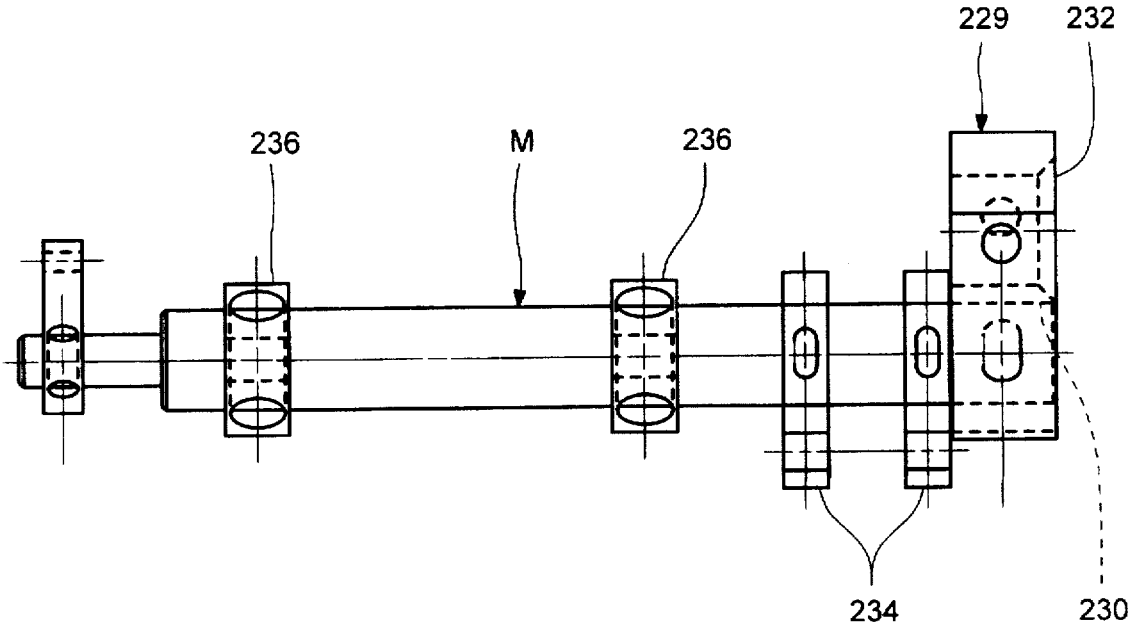

Referring once again to FIGS. 8–19, which depicts the mechanism 20, disposed within the bracket assembly formed by the spaced walls 72, 74, in a closed position (the contacts in the vacuum interrupter 46 are closed). As best seen schematically in FIG. 10 and FIGS. 16–16A, the spring F is retained at its upper end 124 in a fixed inverted centrally apertured 126 cup-like locating and retaining member 128. As seen in FIGS. 16, 16A and FIG. 3, the lower end 130 of the spring F rests within a second cup-like member 132 that is secured by suitable fastening means such as a roll pin 131 along rod 50. Member 132 is accepted piston-like telescopically within chamber 134 of an enlarged third cup-like member 136, (shown spaced in the illustration for clarity of understanding). Apertured plate member 138 is retained by base plate 70 and supports the chambered 134 cup member 136 which has a central bore 142 that readily accepts the axial movement of the lower part 144 of the rod 50 assembly that terminates with connector 52 and clamp-connector 140, the latter adapted to become fixed to the element extending outwardly from vacuum interrupter 46 for actuation of the contacts therein. The upper flattened end 51 of rod 50 extends through aperture 126 in supporting block 128 into the narrow neck 146 of yoke 148 until aperture 150 is aligned with apertures 61. An apertured yoke 62 is caused to overly the assembly and pin 60 finishes the assembly (see FIGS. 18, 13 and 13A). Thus, the spring F is pre-loaded between cups 128 and 132 and will exert a constant downward force, through the rod and connector assembly, to the contacts of the vacuum interrupter 46.

Disposed on opposite outboard sides of the walls 72, 74, are a pair of primary storable motive power tension springs 160. Spring 160 exerts a force through link 162 and pin 164 to rotate lever 166 clockwise about pivot A—A. This rotation is prevented by the latched position of D-shaped latch "C" supported within toggle latch assembly 120 (see FIGS. 11, 11A & 11B) which is also latched in the up position by plunger toggle lever assembly 170. Levers 166 are connected to toggle latch assembly 120 through pin 172, links 174, pin 176, levers 178, latch assembly 180 with its contact plate 182, and pin 184. Toggle latch assembly 180 is prevented from rotating clockwise about pivot pin 184 by the interference of the latch face 182 with the latch C at the surface designated D in FIG. 10. The yoke-like link assembly 148 is being forced to a clockwise rotation about pivot pin 188 by the downward force exerted by spring F through pin 60 telescoped within apertures 61 and 150 of the rod and connector assembly described previously. Pin 190, links 192 and 194 are connected to drive lever assembly 196 to establish the position of pin E. Levers 198 are adjustably positioned in relation to levers 166 via pin 200 and components connector pin 202, adjustment rod 204, spring G, shaft 200 and adjustment screw 112.

Figure 10A:
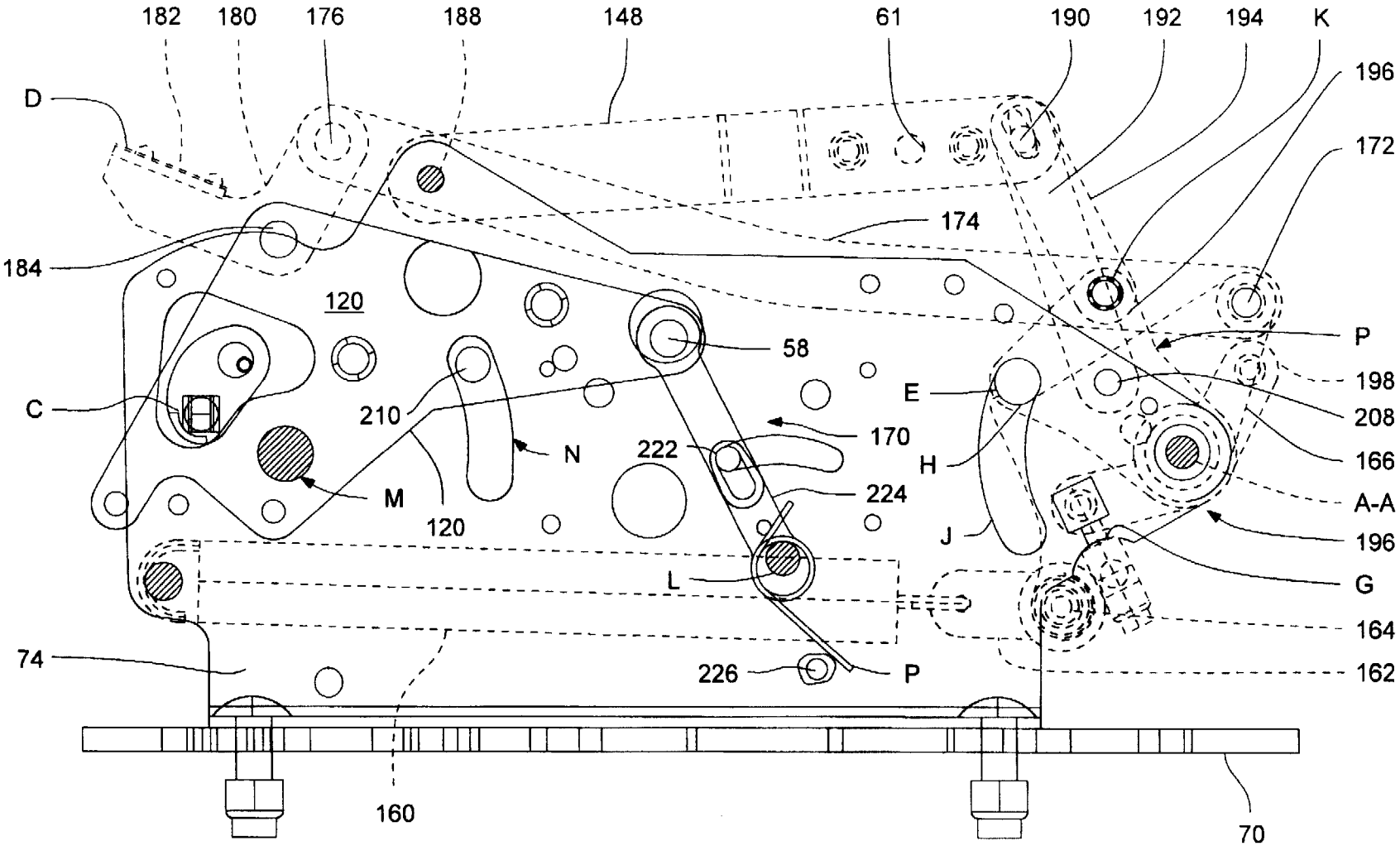
FIG. 10A is an elevational view in partial section, substantially identical to FIG. 10, except that in this view the mechanism is shown in the tripped open position with the toggle latch plate assembly, shown in FIGS. 11, 11A and 11B, is shown in the latched position by the plunger toggle lever assembly, shown in FIGS. 15, 15A.
Figure 10B:
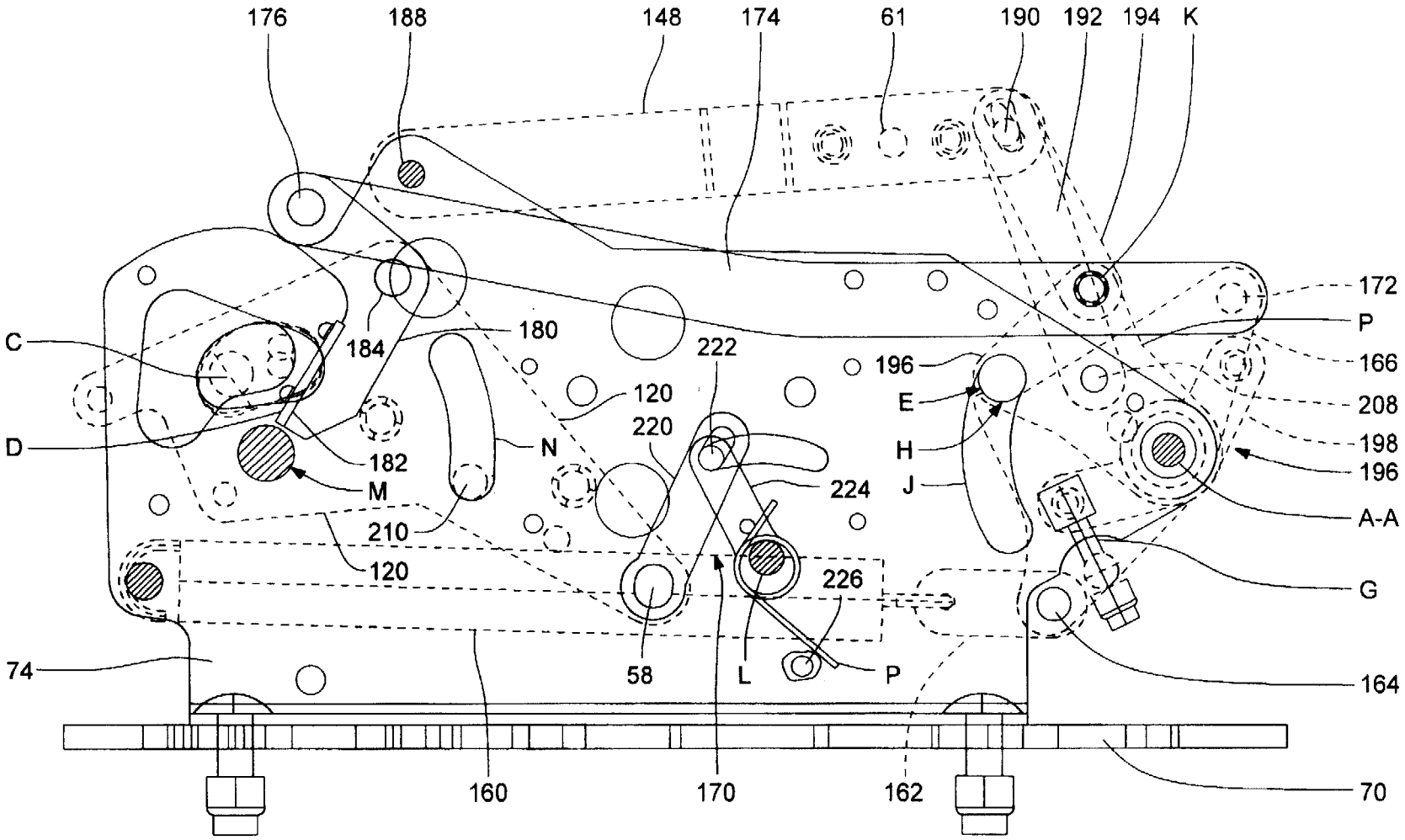
FIG. 10B is an elevational view in partial section, substantially identical to FIG. 10, except that those denoted components are shown in the open position with the toggle latch plate assembly, shown in FIGS. 11, 11A and 11B, is shown in the down reset position.
Figure 12:
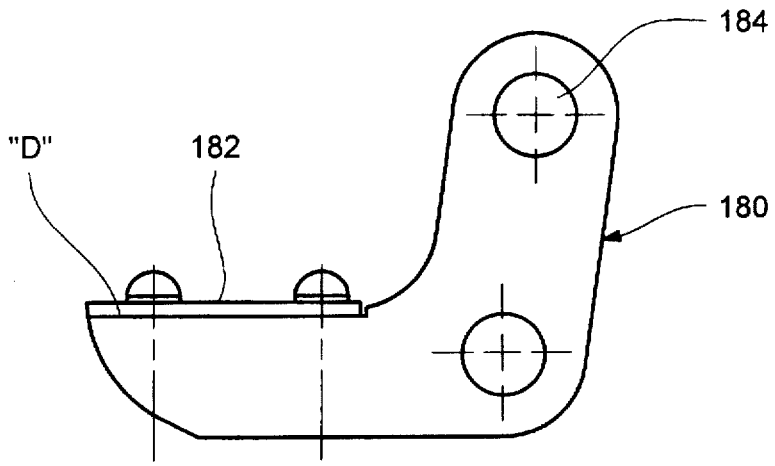
FIG. 12 is an end view of a three piece latch assembly including two end pieces (only one being shown) and a transverse plate or bearing surface 182 mounted on the horizontal arms and adapted for engagement with the cam latch shown in FIG. 11B.
Figure 17:
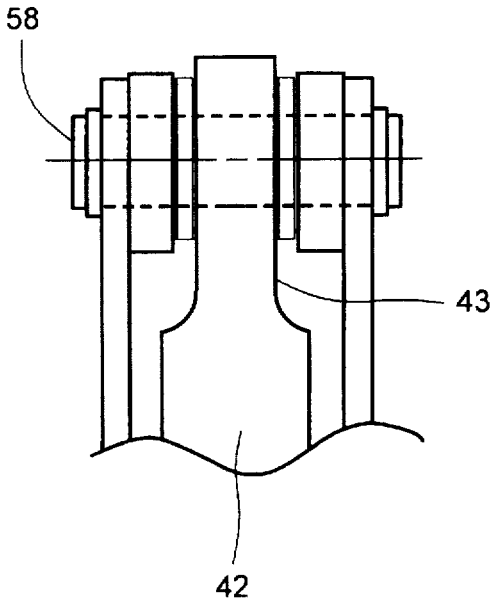
FIG. 17 is a partial fragmentary view of the linkage between the flattened upper end of the drive rod of the pot coil motive force and the mechanism main linkage.
Figure 18:
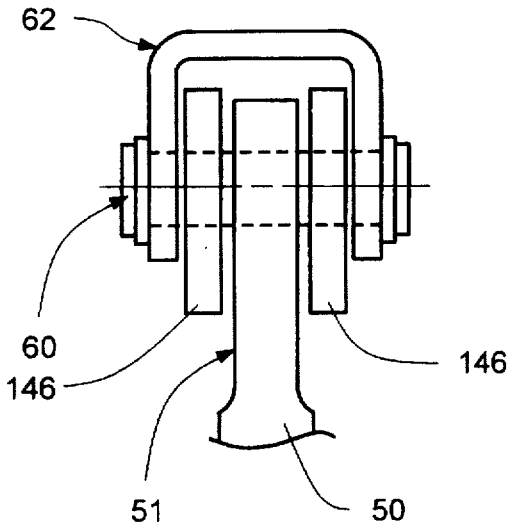
FIG. 18 is the vacuum contact movable rod flattened at its upper end and fastened to the narrow end of the yoke-like assembly shown in FIGS. 13, 13A.

Referring now to FIG. 10A, note that the mechanism linkage is shown in the open position. This position occurred due to the clockwise rotation of latch C clearing the portion D of latch face 182 allowing the clockwise rotation of toggle latch assembly 180 about pin 184 by the force exerted by spring 160 through pin 176, link 174, pin 172, lever 166, pin 164 and links 162. The clockwise rotation of lever 166 about pivot A—A in contact with pin E by the contact surface H of lever 166 has positioned pin E to the top of the slot J of walls 72 and 74. Drive lever assembly 196 has been rotated clockwise about pivot A—A via pin E that it supports. Links 194 and 192 that are attached to drive lever assembly 196 by means of pins K and 208 has driven the right hand end of levers 148, as seen in FIG. 10, to an upward position through pin 190. The movement to the up position, as seen in FIGS. 10A and 10B, of levers 148 which are connected to rod 50 and connector 52 through pin 60 in aperture 61 has moved the contacts of vacuum interrupter 46 to an open position and simultaneously loaded spring F.

This contact opening stroke is accomplished in two incremental phases of rotation by drive lever assembly 196. The first segment of rotation by drive lever assembly 196 has only links 192 in contact with pin 190 to drive levers 148 upward beyond the contact separation of the vacuum interrupter 46. The position of links 192 and pin 208 are so positioned inward to pivot A—A on drive lever 196 to exert a high, consistent predetermined force to break any welds that may have occurred at the vacuum interrupter contacts. The final segment of rotation by drive lever assembly 196 has only links 194 in contact with pin 190 to complete the opening stroke of the interrupter contacts to a specific gap. The rotation of pin K has been driven to a position, dictated by pin E in slot J, beyond a straight line of pin 190 and pivot A—A. Coupled with the constant downward pressure exerted by spring F through levers 148 to links 194 and the smooth transition of pin K through the inline position of pin 190 and pivot A—A the contact overtravel is minimized. The over-center and locked position of pin K and links 194 prevent vacuum interrupter contact rebound to close. The above description completes the opening sequence of the vacuum interrupter contacts as guided by the operating mechanism 20 of the present invention. Referring now to FIG. 10B, the operating mechanism is shown open, except toggle latch assembly 120 has been rotated to the down position. This movement was initiated by a control close signal to energize the electromagnetic release device 92 and forcing the plunger toggle lever assembly 170 to rotate clockwise about pivot L and out of the over center, locked position.

Figure 2:
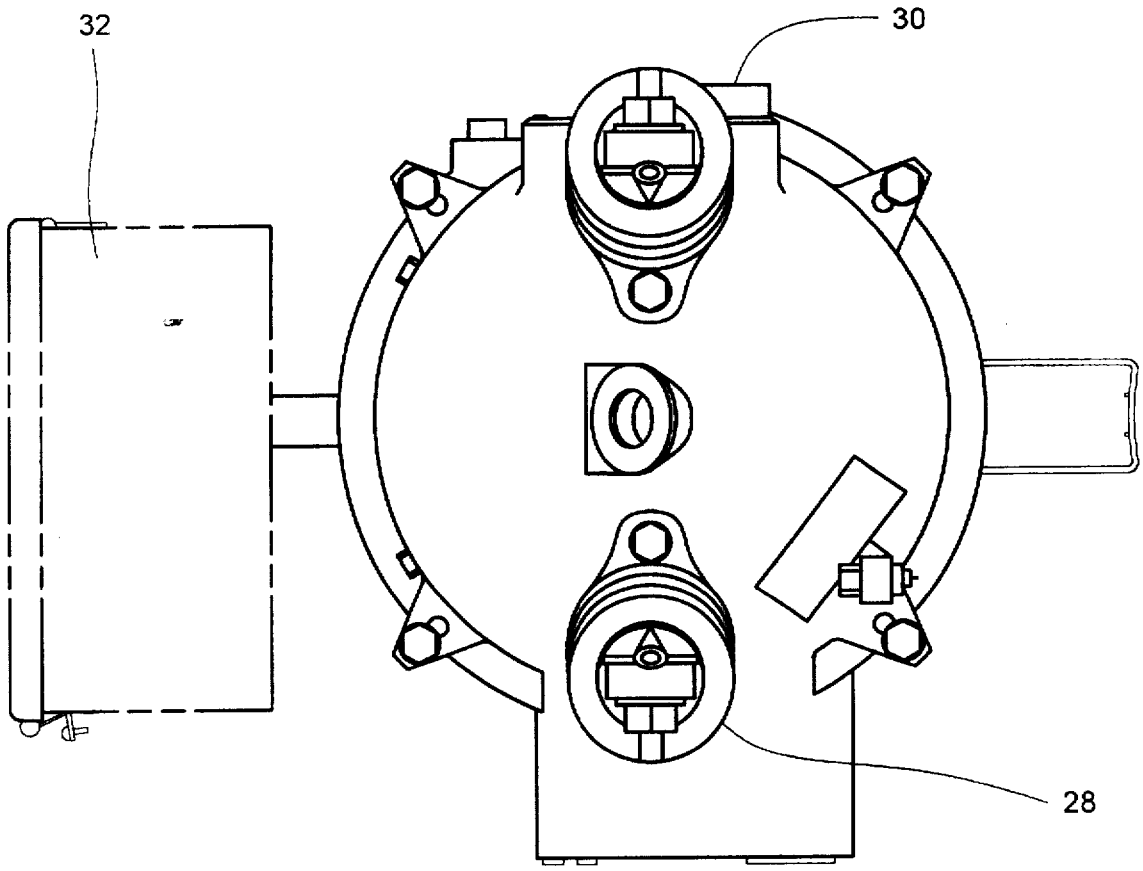
FIG. 2 is a top plan view of the recloser shown in FIG. 1.

It should be interjected at this time that this mechanism contemplates a manual form of completing a close operation in the absence of high voltage for solenoid 38. There is a closing shaft assembly having spaced elements fixedly mounted on shaft M and including at one end a heavy lever 229 provided with radially spaced bores 230 and 232, with bore 230 fixed to shaft M; a pair of small spaced apertured levers 234; and a pair of heavy apertured lever arms 236; with an aperture 237 carrying pin 210 for moving toggle latch plate assembly 120. The manual aspect is provided by an accessory handle (not shown) secured in bore 232 by means of pin 238. Thus, the interrupter can be activated to close manually as well as electrically/electronically. An external manual operating handle 240, shown in FIG. 1, is mechanically linked to parallel operation of close and trip solenoids 90 and 92.

Figure 15:
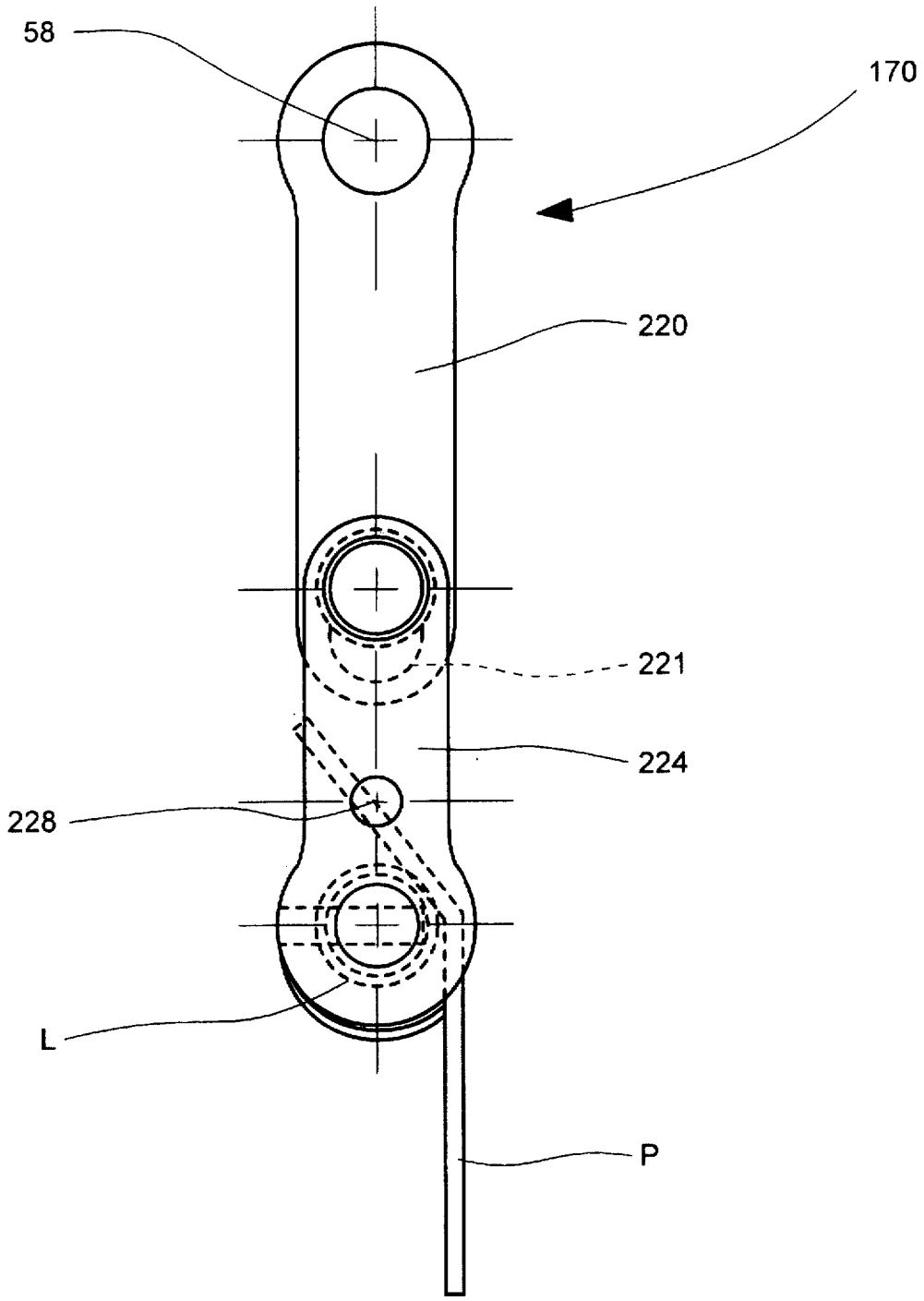
FIGS. 15, 15A is an end view and a front elevational view of the plunger toggle lever assembly.
Figure 15A:
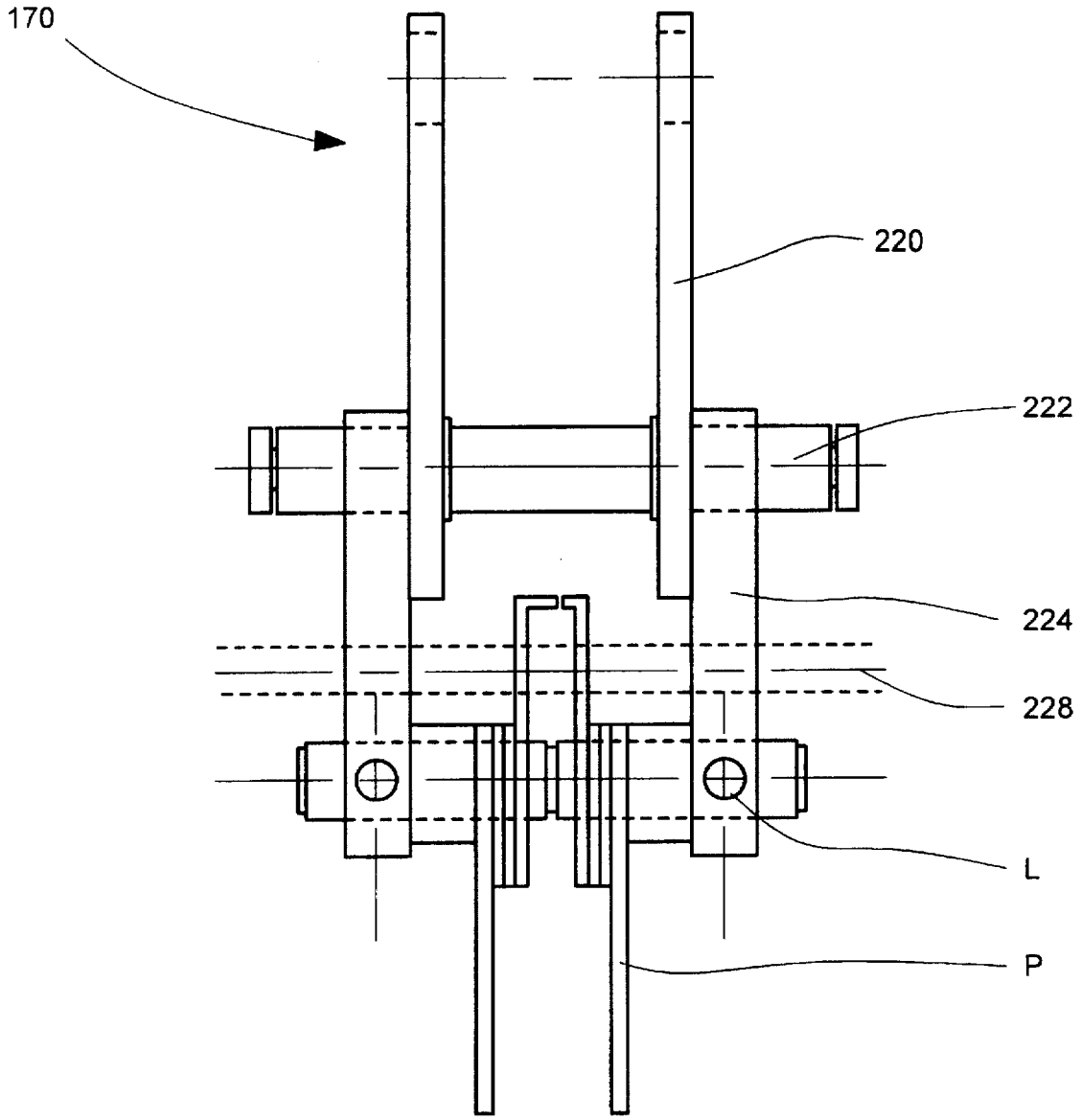
Figure 16:
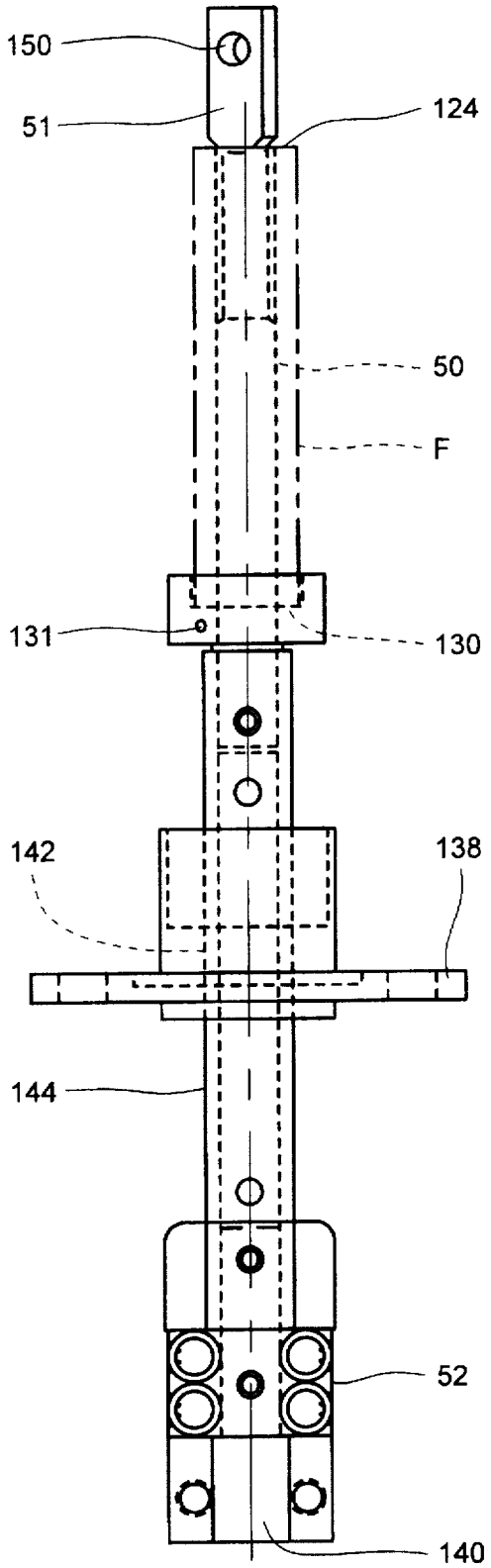
FIG. 16, 16A is a front elevational view and a side elevational view of the rod and connector assembly having a partially loaded spring, shown schematically, at the upper end of, the rod, and retained on said rod by a pair of centrally apertured shallow cups which are spaced and secured along the rod; with the lower one of said shallow cups being acceptable within a chamber of a secondary larger cup for damping purposes. The lower end of said rod, as illustrated, including a high amperage connector means.
Figure 16A:
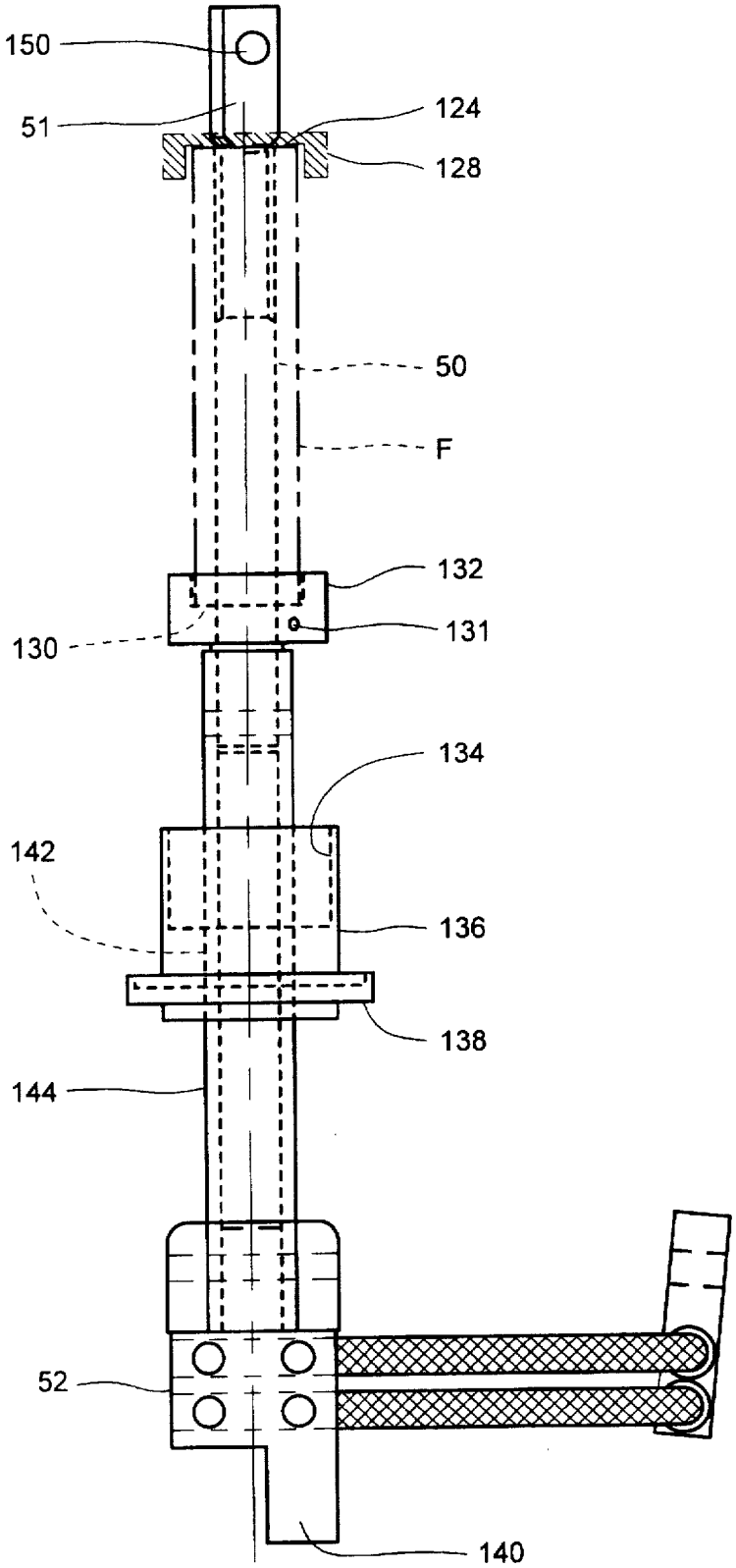
Figure 19:
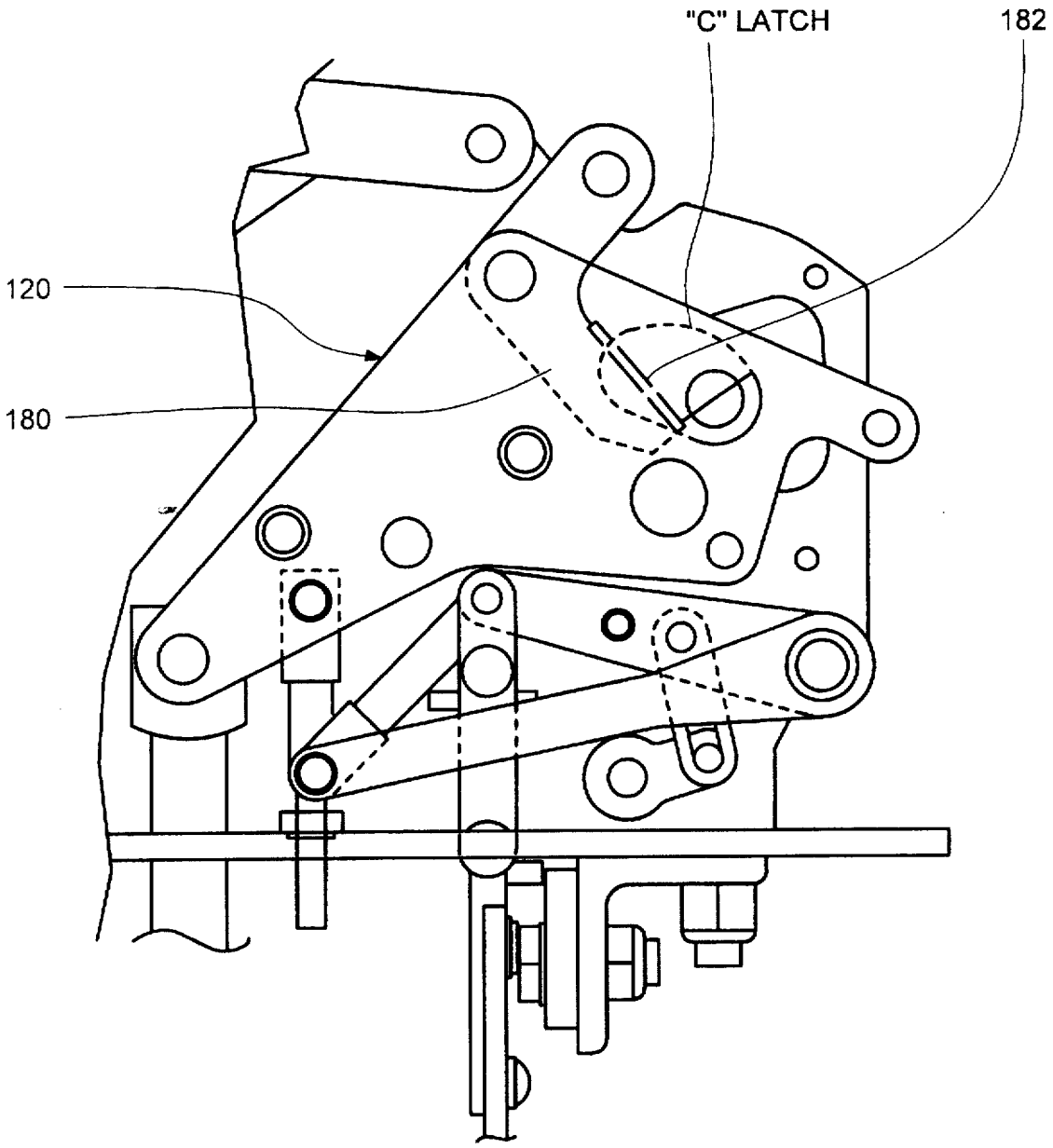
FIG. 19 is a partial fragmentary elevational view of the toggle latch plate assembly and a D-shaped latch, designated "C", with its associated links and rods, as seen from its backside, or opposite end, contra to the views shown as the frontside in FIGS. 10, 11, and 12.

Plunger toggle lever assembly 170, as best seen in FIGS. 15 & 15A, includes a pair of spaced levers 220 that are apertured at their free ends to accept pin 58 while at their opposite or central end they are provided with an oval hole 221. A pair of heavier gauge levers 224 are spaced outboard of levers 220 and are joined thereto by pin 222, while at their free ends levers 224 carry a fixed pin L which it in turn carries a torsion spring P, the free ends of spring P being adapted to contact fixed spring anchor 226 and fixed pin 228.

A downward pressure by a spring about shaft M and the plunger weight on the plunger rod assembly 42 by pin 58 forces toggles latch assembly 120 to rotate clockwise to the lower limit of pin 210 in slot N. This clockwise rotation has rotated latch assembly 180 counterclockwise into a reset position with latch C with overtravel to insure positive engagement. The clockwise rotation of the toggle latch 120 drives pivot pin 104 down beyond the over center position of lever 100 allowing spring 122 to force lever 100 to rotate counter clockwise moving the contactor link 56 to the up stop position where pin 212 adjoins the lower surface of plate 70. The upward movement of the closing solenoid contactor link 56 allows the energization of the pot coil assembly 38. This coil energization will begin the closing function. Plunger 40 and rod assembly 42 are forced upward by the electromagnetic force of the pot coil 38 and being attached to toggle latch assembly 120 by pin 58, rotate said assembly 120 counterclockwise to the latched position of plunger toggle lever assembly 170 (as seen in FIG. 10) At this latched position the closing solenoid contactor 44 has been driven open to de-energize the pot coil assembly 38 by the associated linkage of 100, 108, 110, 102, 112A, 106, 122 and 104 being returned to the position shown in FIG. 10. The counterclockwise rotation of latch assembly 120 has also urged levers 166 through components 180, 184, 178, 174, 176, and 172 to rotate counterclockwise and extend springs 160 to a fully charged state.

Referring back to FIGS. 10 and 10B, levers 198 through attachment to levers 166 via pin 200 also rotate counterclockwise moving pin 202 into contact with detent surface P forcing drive lever assembly 196 and links 194 out of the locked position allowing the downward pressure exerted by spring F to collapse the multi-linked system of links 194, 192, and drive lever 196 to the down position shown in section 10—10, i.e. see FIG. 10. Components 202, 204, 200, 112, and spring G provide adjustment to obtain the mechanical sequence of remaking the plunger toggle lever assembly 170 to its overcenter position, followed by closing of the vacuum interrupter contacts.

Referring to FIG. 10 as well as FIGS. 16, 16A, spring F is exerting a force to the piston 132 and has moved the contacts of the vacuum interrupter 46 to a closed position. Having a spring F loaded to a predetermined pressure, the force applied at contact make is instantaneous without delay. This time is critical in minimizing contact rebound, blow open, and contact welding upon initial contact make especially at high fault current levels. The contact closing velocity has been modified to reduce the impact energy at the interrupter contacts via piston 132 and piston chamber 134, utilizing transformer oil in chamber 134 to provide hydraulic dampening. The piston 132 is directly attached to the contact rod 50 and the piston chamber 134 is attached to the base plate 70 by means of retaining plate 138 (see FIGS. 3, 16, & 16A).

A verbal schematic description of the procedure followed by the mechanism 20 that hopefully will simplify its operation follows: First, assuming the mechanism is in a "closed" position and the vacuum interrupter contacts were carrying the load current and an over current condition exists on the line the following would occur: The electronic control 32 under this condition would issue a trip signal to one of the two flux shift trippers, that being the trip flux tripper 90. That releases the toggle latch 120 allowing the opening springs 160 which were in a fully loaded state to simultaneously pull the contacts of the vacuum interrupter 46 to the open position. That is, the opening springs 160 will discharge and simultaneously open the vacuum interrupter contacts as well as rearming the closing spring F. At that point in time the electronic control 32 from various sensing positions in the mechanism will realize that the contacts of the vacuum interrupter are indeed in the open position and the fault has been interrupted. There is no load current, the control 32 then decides to issue a reclosing signal to the closing flux shift tripper, recloser 92. When the closing flux shift tripper 92 is energized it essentially releases a toggle latch C on the toggle latch assembly 120 which allows the plunger to drop. When the main pot coil plunger drops it overtoggles the pot switch linkage closing our high voltage contactor 44 of the pot switch linkage. That energizes the high voltage closing coil 38, the high voltage closing coil then drives the closing coil plunger 40 and rod 42 back upwards in an upward motion (as seen in the drawing). The opening springs 160 again being recharged and as that closing stroke is continuing near the end of the stroke, the hot switch 44 is being biased back to the open position which de-energizes the high voltage closing solenoid 38. The hot switch 44 now is in the open condition, the toggle assembly 120 is being latched in the full upward position, the opening springs 160 are fully armed and at the very end of the plunger stroke 42, through the mobile link system, over toggles the closing spring F which was fully charged as discussed previously and that drives the vacuum interrupter 46 contacts back closed again. At this point in time we are back on line again. If there are one or more continued faults, the device then goes through a program sequence and the control 32, if the fault is permanent, counts the number of sequences and when a predetermined number is reached the electronic control 32 decides it's permanent then we stand a lock out condition which just simply means the electronics gives no more closing signals.

Thusly, the closing spring F and the opening spring 160 are both brought to fully loaded condition before the opposite number is activated, namely, that in the event that some line activity takes place either at or just before the closing function the opening function spring 160 has already been fully loaded. Similarly; the closing function spring F has been fully loaded prior to opening spring 160 being released. Whereas, the prior art cited above do not have this luxury since these closing and opening functions in those devices all require some secondary action. Either the closing of the contacts is not at instantaneous full pressure, or, the separation of the contacts is not at full power and capable of opening up welded condition contacts.

Thus, structure and function have been provided to support the allegation that this invention solves the seven problems originally proffered.

We claim:

1. An operating mechanism for producing controlled linear motion at at least one of a plurality of stations wherein said controlled linear motion is utilized to independently open and close linearly moveable electrical contacts, said mechanism including means for producing a dynamic motive force at each of said stations, a first static energy storage means for opening the electrical contacts, a second static energy storage means for closing the electrical contacts, means for releasing said static energy of said first and said second static energy storage means to carry out the opening and closing of said contacts, and to provide an unvarying uniform high force required from making contact and up to and at contact separation, and means for preloading said first static energy storing means prior to releasing the static energy of the second static energy storage means.

2. An operating mechanism as claimed in claim 1 wherein means are provided whereby contact rebound after opening of said contacts or at contact separation is controlled within predetermined parameters.

3. An operating mechanism as claimed in claim 1 wherein said first static energy storage means is at least one tension spring.

4. An operating mechanism as claimed in claim 3, wherein said tension spring releases its energy for an opening operation from a fully charged state.

5. An operating mechanism as claimed in claim 1 wherein said second static energy storage means is at least one pre-loaded compression spring.

6. An operating mechanism as claimed in claim 1 wherein means are provided for maintaining a closing energy invariably uniform and independent of any variable charging means.

7. An operating mechanism as claimed in claim 6 wherein said charging means includes the compression spring which is preloaded and reciprocally mounted on a rigid rod member connected to movable contact means, and wherein said mechanism includes a fixed contact means, said compression spring urging said moveable contact means with a predetermined pressure toward said fixed contact means, wherein said moveable contact means maintains a predetermined immediate unvarying pressure against said fixed contact from a first physical contact between said moveable and said fixed contacts thereby eliminating any time delay in reaching full contact pressure after said first physical contact, and linkage means for maintaining said moveable and said fixed contact means in an intimate unvarying juxtaposed pressure relation.

8. An operating mechanism as claimed in claim 7 wherein said compression spring encircles said rigid rod member and is axially telescoped within and captured between two inwardly facing upper and lower cup-like members, wherein the lower of said cup-like members is fixed to said rod while the upper of said cup-like members is slidable along said rod but fixed relative to said upper cup-like member's environment, said lower cup-like member serves as an inverted piston means within a complimentary open chamber containing a non-compressible liquid which serves as a buffer against any possible rebound of said rod.

9. An operating mechanism as claimed in claim 1, further comprising means for preloading the second static energy storing means prior to releasing the static energy of the first static energy storing means.

10. In a high voltage electrical vacuum interrupter having at least one fixed and one moveable contact means, an operating mechanism comprising:

means for providing a linear motive force for driving said operating mechanism, mechanical means for translating said linear motive force to a controllable functional means capable of operating said moveable contact means within pre-determined parameters, wherein an unvarying, substantially uniform high force is provided between said vacuum interrupter contacts during a closed state between said contacts, and wherein said mechanical means comprises at least one compression spring and a multi-link system that provides a high contact separation force and prevents contact rebound after the contacts are opened, and wherein said multi-link system includes at least one tension spring and means for discharging said at least one tension spring such that the discharging of said at least one tension spring causes the at least one compression spring to become re-armed.

11. An operating mechanism for opening and closing linear moving members on single or multiphase circuit interrupters, said mechanism comprising:

a first spring for exerting a substantially high closing pressure on a set of interrupter contacts while the contacts are in a closed state, a second spring which drives a multi-linked system means for providing high contact separation forces and for moving the interrupter contacts from a closed position to an open position with precise, controlled movement thus minimizing opening rebound and contact opening overtravel, said mechanism providing and maintaining full unvarying constant closing pressure on the interrupter contacts from an instant contact is made between said interrupter contacts to an instant said interrupter contacts undergo contact separation, wherein each of said first and said second springs is fully charged and latched by said multi-linked system prior to the other spring being utilized to carry out its assigned function, wherein each of said first and said second springs is capable of fulfilling its function immediately upon being charged.

12. An operating mechanism as claimed in claim 11 wherein said multi-linked system charges the second spring prior to releasing the first spring and subsequent closing said interrupter contacts.

13. An operating mechanism as claimed in claim 11, wherein said operating mechanism includes a source of motive power in the form of a pot coil assembly having a plunger and connecting rod; an opening and closing solenoid contactori a vacuum interrupter having associated support members; a spring loaded rod and connector assembly providing linear movement through a sealed bellows for contacts located in said vacuum interrupter; and a current transformer for sensing the line current of a power line with which the mechanism is interposed.

* * * * *